United States Patent [19]

Niki et al.

[11] Patent Number: 4,845,005

[45] Date of Patent: Jul. 4, 1989

[54] DRY DEVELOPER COMPOSITION COMPRISING POLYMER BINDER RESIN AND COLORANT

[75] Inventors: Masao Niki; Zenbei Meiwa, both of Wakayama, Japan

[73] Assignee: Kao Corporation, Tokyo, Japan

[21] Appl. No.: 567,380

[22] Filed: Dec. 30, 1983

[30] Foreign Application Priority Data

Jan. 12, 1983 [JP] Japan ..... 58-3209

[51] Int. Cl.[4] ..... G03G 9/00; G03G 9/08

[52] U.S. Cl. ..... 430/120; 430/109; 430/110

[58] Field of Search ..... 430/109, 110; 434/120

[56] References Cited

U.S. PATENT DOCUMENTS

| | | | |
|---|---|---|---|
| 2,892,794 | 6/1959 | Insalaco | 430/109 X |
| 3,933,665 | 1/1976 | Van Engeland et al. | 430/110 X |
| 3,941,898 | 2/1976 | Sadamatsu et al. | 430/110 X |
| 3,959,153 | 5/1976 | Sadamatsu et al. | 430/109 X |
| 3,980,576 | 9/1976 | Vijayendran | 430/109 |
| 4,314,931 | 2/1982 | Hoffend et al. | 430/109 X |
| 4,386,147 | 5/1983 | Seimiya et al. | 430/109 X |

FOREIGN PATENT DOCUMENTS

| | | | |
|---|---|---|---|
| 0005334 | 11/1979 | European Pat. Off. | 430/110 |
| 7118122 | 5/1972 | Netherlands | 430/109 |
| 2078385 | 1/1982 | United Kingdom | 430/109 |
| 2081280 | 2/1982 | United Kingdom | 430/109 |

*Primary Examiner*—Mukund J. Shah

*Attorney, Agent, or Firm*—Birch, Stewart, Kolasch & Birch

[57] ABSTRACT

A dry developer composition for electrophotography is disclosed capable of retaining a positive charge and comprises a binder resin and a colorant, the binder resin being a polymer obtained by polymerizing, in a suspension, (A) 98 to 99.95 parts by weight of a hydrophobic copolymerizable monomer and (B) 0.05 to 2.0 parts by weight of a tertiary amino group-containing copolymerizable monomer having the formula (1):

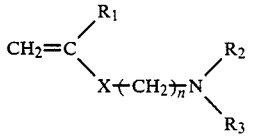

(1)

in which R1 is hydrogen or methyl, X is —COO— or —CONH—, R2 and R3 are each an alkyl having 1 to 4 carbon atoms or an aryl and n is an integer of 1 to 4, in the presence of (C) 0.5 to 5.0 parts by weight of an azonitrile polymerization initiator.

5 Claims, No Drawings

DRY DEVELOPER COMPOSITION COMPRISING POLYMER BINDER RESIN AND COLORANT

BACKGROUND OF THE INVENTION

The present invention relates to a dry developer for electrophotography, and more particularly to a dry developer for electrophotography which is stable during use to variations in ambient conditions has good resistance to the offset phenomenon as discussed below in hot roll fixation and has an improved positive chargeability.

In general, electrophotography involves direct or indirect production of a toner image on an image receiving sheet either by a method in which developer particles (toner) electrically charged by friction to a polarity opposite to that of an electrostatic latent image are attracted to the latent image electrostatically (normal development) or by a method in which a toner electrically charged to the same polarity as that of a latent image is attracted to the latent image by an electric field generated between a magnetic brush and the latent image surface (reversal development).

The toner image is fixed to the image receiving sheet by heating, application of pressure, contact with solvent vapor or other similar means, to complete recording.

Of various fixing processes, a hot roll fixing process which involves direct contact of the toner image with the image receiving sheet has merits of excellent thermal efficiency, a high fixing speed and a small size of equipment. But, on the other hand, this process has a disadvantage of generating the so-called offset phenomenon in which toner particles adhere to the hot roll upon contact with the latter and re-adhere to a subsequent image receiving sheet. As a countermeasure against this phenomenon, a method of coating the roll surface with a releasing agent has been proposed, but this method requires complicated equipment and induces difficulties in maintenance. Accordingly, there is a keen demand for an offset-proof toner binder free of any releasing agent.

In addition, the role of the toner in producing the abovementioned image lies in providing a distinct polarity with respect to the electric field of the latent image and a stable charge quantity. A toner generally consists of a binder, a colorant and other additives, wherein the binder is the major constituent. Examples of the binder in general include coumarone-indene resins, terpene resins, resins based on styrene or compolymers thereof, polyester resins and epoxy resins, but almost none of the resins acquire positive polarity in charging by friction with iron powders.

To obtain a positively chargeable toner, a method of introducing amino groups into the binder resin and a method of adding a nigrosine dye or other additives as a positive polarity controlling agent are commonly known.

The former method, however, is disadvantageous in that although the positive chargeability is enhanced with an increase in the quantity of amino groups introduced, the chargeability fluctuates with variations in ambient humidity so that stable images cannot always be obtained.

The latter method, on the other hand, is disadvantageous in that the nigrosine dye is poor in compatibility with the binder resin used as the major constituent of the toner, that the concentration of the dye becomes non-uniform upon pulverization to degrade the image quality, that the nigrosine dye itself is unstable to ambient humidity because of its hydrophilic property, and in addition, is not suitable for coloring the toner because of its densely colored condition, etc.

SUMMARY OF THE INVENTION

Accordingly, an object of the present invention is to provide a dry developer for electrophotography which is improved with respect to the abovementioned disadvantages by using a positively chargeable binder resin excellent in resistance to ambient conditions. More particularly, an object of the present invention is to provide a dry developer for electrophotography by which a clear, fog-free image of high quality can be obtained and in which a binder used as the major constituent of a toner consists of a resin capable of being intensely charged to a positive polarity, retaining constantly a stable chargeability under variations in ambient humidity, and being free from the offset phenomenon in a hot roll fixing process.

The present inventors have discovered, as a result of their earnest studies intended to accomplish the abovementioned objects of the present invention, that when a polymer obtained by suspension polymerization of a hydrophobic monomer with a tertiary amino group-containing copolymerizable monomer by the use of an azonitrile polymerization initiator is used as a binder resin of a dry developer for electrophotography which comprises a binder resin and a pigment as main constituents, the quantity of hydrophilic groups having positive polarity can be reduced and the accompanying reduction in the charge quantity can be compensated for by a synergistic effect arising from the joint use of the azonitrile polymerization initiator.

DETAILED DESCRIPTION

Accordingly, the present invention resides in a dry developer for electrophotography comprising a binder and a colorant as main constituents, characterized in that a major constituent of the binder resin is a polymer obtained by suspension polymerization of a monomeric mixture of 98 to 99.95 parts by weight of a hydrophobic copolymerizable monomer and 0.05 to 2.0 parts by weight of a tertiary amino group-containing copolymerizable monomer of formula (1):

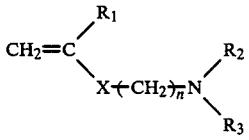

(1)

where $R_1$ is hydrogen or a methyl group, X is —COO— or —CONH—, $R_2$ and $R_3$ are each an alkyl group having 1 to 4 carbon atoms or an aryl group, and n is an integer of 1 to 4, in the presence of 0.5 to 5.0 parts by weight of an azonitrile polymerization initiator. A portion, up to 2 parts by weight, of the hydrophobic copolymerizable monomer may be replaced by a cross-linking agent to cross-link the monomers.

The hydrophobic copolymerizable monomer used in the present invention has a solubility in water of not higher than 1.0% by weight, or, alternatively, the solubility of water in the monomer is not higher than 1.0% by weight. Examples of the monomer include: styrenic monomers such as styrene, α-methylstyrene, vinyltoluene and dimethylstyrene, (meth)acrylate monomers such as n-butyl acrylate, iso-butyl acrylate, 2-ethylhexyl acrylate, n-butyl methacrylate; iso-butyl methacrylate, 2-ethylhexyl methacrylate and lauryl methacrylate.

The tertiary amino group-containing copolymerizable monomer used in the present invention is represented by the following formula:

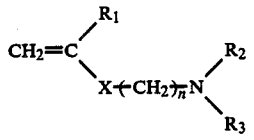

where $R_1$ is hydrogen or a methyl group, X is —COO— or —CONH—, n is an integer of 1 to 4, and $R_2$ and $R_3$ are each an alkyl group having 1 to 4 carbon atoms or an aryl group such as phenyl, preferably an alkyl having 2 to 4 carbon atoms. Examples of the monomer include dimethylaminoethyl methacrylate, diethylaminoethyl methacrylate, diethylaminoethyl acrylate, and dimethylaminopropylmethacrylamide.

The azonitrile polymerization initiator is preferably a compound in which a group of the formula

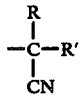

(wherein R and R′ are each an alkyl or alkoxyalkyl group having 1 to 5 carbon atoms) is bonded to at least one side of the azo group, and examples thereof include azobisisobutyronitrile, azobisdimethylvaleronitrile, azobis (2,4-dimethyl-4-methoxyvaleronitrile), and 2-phenylazo(2,4-dimethyl-4-methoxyvaleronitrile).

In the present invention it is necessary to use a larger quantity of the azonitrile polymerization initiator, since the quantity of frictionally induced charges is reduced with a decrease in the copolymerizing ratio of the tertiary amino group-containing copolymerizable monomer. When the quantity of the initiator used is excessively large, the molecular weight of the resultant copolymer will be so small that physical properties will be poor. Accordingly, the quantity of the initiator used should be 0.5 to 5.0 parts by weight per 100 parts by weight of the total quantity of the monomers.

In addition, although an increase in the copolymerizing ratio of the tertiary amino group-containing copolymerizable monomer results in an increase in the charge quantity, the monomer is hydrophilic so that the quantity of charges induced on the copolymer obtained from the monomer is greatly affected by ambient humidity, and the charge quantity is reduced in a high humidity. To obtain a copolymer hardly affected by ambient conditions, therefore, it is necessary to copolymerize the monomeric mixture in such a quantity range that 98 to 99.95 parts by weight of the hydrophobic copolymerizable monomer exists with 0.05 to 2.0 parts by weight of the tertiary amino group-containing copolymerizable monomer.

The present applicant has previously discovered a dry developer for electrophotography comprising a binder resin and a colorant, wherein a major constituent of the binder resin is a polymer obtained by polymerizing a tertiary amino group-containing copolymerizable monomer with a hydrophobic copolymerizable monomer in a homogeneous system by the use of an azonitrile polymerization initiator. That is disclosed in U.S. Ser. No. 422,416 filed Sep. 23, 1982. After further investigations, the applicant has discovered that when a specified polymerization recipe using the tertiary amino group-containing copolymerizable monomer as mentioned above is employed, a copolymer capable of being electrically charged to a positive polarity with a relatively uniform charge distribution can be obtained also by suspension polymerization.

As a stabilizer for dispersion of suspended particles in the suspension polymerization, wellknown protective colloids can be used, for example, polyvinyl alcohol and partially saponified polyvinyl alcohol, cellulose derivatives such as hydroxyethylcellulose and carboxymethylcellulose, and polyvinylpyrrolidone.

The cross-linking agent may be any of well-known cross-linking agents which have two or more copolymerizable unsaturated groups in a molecule, for example, di- or tri(meth)acrylates of polyols such as alkylene diol, oxyalkylene diol, polyoxyalkylene diol and oligoester diol, and divinylbenzene, which may be used either alone or in combination.

The binder resin obtained according to the present invention can be used mixing with other binder resins, in such a range as not to damage, the physical properties.

PREFERRED EMBODIMENTS

The present invention will now be described in more detail, referring to Experimental Example. Examples and Comparative Examples of preparation of the binder, the toner and the developer. Evaluation results of the examples are summarized in Table 1. In the examples which follow, all the quantities of materials are expressed in parts by weight.

Experimental Example:

Deionized water and a protective colloid were placed in a four-necked flask equipped with an agitator, a reflux condenser, a thermometer and a nitrogen inlet tube to dissolve the colloid in water by heating up to 80° C. with agitation. Then dissolved oxygen in the aqueous phase and air in the gaseous phase were replaced by nitrogen, and a mixture of monomers and a polymerization initiator were dropped into the aqueous solution for 2 hours to effect polymerization.

After dropping was completed, the reaction mixture was maintained under that condition for 4 hours to bring the polymerization to completion and, after cooling, the polymerizate was filtered to separate a particulate resin, which was dried to obtain a binder resin.

93 parts by weight of the binder resin thus obtained and 7 parts by weight of a coloring pigment were premixed with each other by a supermixer, and the resultant premixture was then melt-kneaded in a pressure kneader to obtain a resin with the pigment dispersed therein. The resin/pigment mixture was roughly ground by a cutter mill, was further pulverized by an air-jet mill, and was classified to obtain a particulate toner with a particle size of 5 to 30 μm and an average particle size of 12 to 15 μm. 5 parts of the toner was mixed with 95 parts of a commercially available iron powder carrier in a ball mill for 30 minutes, to obtain a developer.

Example 1

70 parts of α-methylstyrene, 28 parts of butyl acrylate, 1.8 parts of diethylaminoethyl methacrylate and 0.2 parts of divinylbenzene were polymerized in the presence of 1.0 part of azobisisobutyronitrile by using the equipment mentioned in Experimental Example above. The resultant resin had a softening point (JIS K-2531, hereinafter abbreviated as SP) of 128° C. and a glass transition point (hereinafter abbreviated as $T_g$) of 65° C. From this resin and Mitsubishi Carbon #44 (a product of Mitsubishi Chemical Industries) as a colorant, a toner was prepared. The toner and a commercially available iron powder carrier were processed by the method described in Experimental Example, to obtain a developer.

Example 2

86.2 parts of styrene, 11.7 parts of 2-ethylhexyl acrylate, 2.0 parts of dimethylaminoethyl methacrylate and 0.1 part of divinylbenzene were polymerized in the presence of 2.0 parts of azobisdimethylvaleronitrile in the same manner as in Example 1. The SP of the resultant resin was 132° C., and the $T_g$ was 66° C. A toner was prepared by using the resin with the Mitsubishi Carbon #44, and a developer was obtained therefrom.

Example 3

84.7 parts of strene, 14.0 parts of 2-ethylhexyl acrylate, 1.0 part of diethylaminoethyl methacrylate and 0.75 parts of an oligoester diacrylate NK Ester 9G (a product of Shin-Yamamoto Kogyo K.K.) were polymerized in the presence of 2.0 parts of azobisisobutyronitrile in the same manner as in Example 1, to obtain a resin having an SP of 140.5° C. and a $T_g$ of 58° C. A toner was prepared by using the resin with the Mitsubishi Carbon #44, and a developer was obtained therefrom. Example 4:

84.7 parts of styrene, 14.0 parts of 2-ethylhexyl acrylate, 1.0 part of dimethylaminoethyl methacrylate and 0.29 parts of 1,6-hexanediol diacrylate were polymerized in the presence of 2.0 parts of azobisdimethylvaleronitrile in the same manner as in Example 1, to obtain a resin having an SP of 146° C. and a $T_g$ of 61° C. A toner was prepared by using the resin with the Mitsubishi Carbon #44, and a developer was obtained therefrom.

Example 5

78.9 parts of styrene, 20.0 parts of isobutyl acrylate, 1.0 part of diethylaminoethyl methacrylate and 0.1 part of divinylbenzene were polymerized in the presence of 1.0 part of azobis(4-methoxy-2,4-dimethylvaleronitrile) and 1.0 part of azobisisobutyronitrile as in Example 1, to obtain a resin having an SP of 125° C. and a $T_g$ of 63.5° C. A toner was prepared by using the resin with the Mitsubishi Carbon #44, and a developer was obtained therefrom.

Example 6

74.9 parts of vinyltoluene, 23.0 parts of 2-ethylhexyl methacrylate, 2.0 parts of diethylaminopropylmethacrylamide and 0.1 part of divinylbenzene were polymerized in the presence of 2.5 parts of azobisdimethylvaleronitrile as in Example 1, to obtain a resin having an SP of 126° C. and a $T_g$ of 60.5° C. A toner was prepared by using the resin with the Mitsubishi Carbon #44, and a developer was obtained therefrom.

Comparative Example 1

79.7 parts of styrene, 12.0 parts of butyl acrylate, 8.0 parts of dimethylaminoethyl methacrylate and 0.3 parts of divinylbenzene were polymerized in the presence of 2.0 parts of azobisisobutyronitrile as in Example 1, to obtain a resin having an SP of 137° C. and a $T_g$ of 63.2° C. A toner was prepared by using the resin with the Mitsubishi Carbon #44, and a developer was obtained therefrom.

Comparative Example 2

45.0 parts of styrene, 34.7 parts of methyl methacrylate, 14.0 parts of 2-ethylhexyl acrylate and 6.3 parts of dimethylaminoethyl methacrylate were polymerized in the presence of 2.0 parts of azobisdimethylvaleronitrile as in Example 1, to obtain a resin having an SP of 142.8° C. and a $T_g$ of 64.0° C. A toner was prepared by using the resin with the Mitsubishi Carbon #44, and a developer was obtained therefrom.

Comparative Example 3

84.7 parts of styrene, 14.3 parts of 2-ethylhexyl acrylate and 1.0 part of dimethylaminoethyl methacrylate were polymerized in the presence of 2.0 parts of dimethyl 2,2'-azobisisobutyrate as in Example 1, to obtain a resin having an SP of 132.2° C. and a $T_g$ of 66.0° C. A toner was prepared by using the resin and the Mitsubishi Carbon #44, and a developer was obtained therefrom.

Comparative Example 4

85.0 parts of styrene and 15.0 parts of butyl acrylate were polymerized in the presence of 1.0 part of benzoyl peroxide as in Example 1, to obtain a resin having an SP of 128.5° C. and a $T_g$ to 63.8° C. A toner was prepared by using 100 parts of the resin with 3 parts of nigrosine base EX (a product of Orient chemical Industries) and the Mitsubishi Carbon #44, and a developer was obtained therefrom.

Comparative Example 5

85.0 parts of styrene, 13.9 parts of 2-ethylhexyl acrylate and 1.0 part of dimethylaminoethyl methacrylate were polymerized in the presence of 0.3 parts of azobisdimethylvaleronitrile as in Example 1, to obtain a resin having an SP of 147.8° C. and a $T_g$ of 67.1° C. A toner was prepared by using the resin with the Mitsubishi Carbon #44, and a developer was obtained therefrom.

Comparative Example 6

85.0 parts of styrene, 14.0 parts of butyl acrylate and 1.0 part of dimethylaminoethyl methacrylate were polymerized in the presence of 2.0 parts of benzoyl peroxide as in Example 1, to obtain a resin having an SP of 130.5° C. and a $T_g$ of 62° C. A toner was prepared by using the resin with the Mitsubishi Carbon #44, and a developer was obtained therefrom.

The toners prepared and conditioned in Examples 1 to 6 and Comparative Examples 1 to 6 were measured for the quantity of electric charge induced thereon by friction with the iron powder carrier. The developers obtained above were used on a copying machine equipped with a commercially available organic photoconductor (OPC) under various ambient conditions, and the copy quality was observed. The results of the measurement and the observation are shown in Table 1. As is seen from Table 1, the developers according to the present invention produced stable images even under highly humid conditions.

TABLE 1

| Toner Samples | Items: Ambient Condition (I)*1 Q/M*3 | Ambient Condition (I)*1 Copy quality | Ambient Condition (II)*2 Q/M*3 | Ambient Condition (II)*2 Copy quality |
|---|---|---|---|---|
| Ex. 1 | +18.6 | good | +18.2 | good |
| Ex. 2 | +17.2 | " | +16.1 | " |
| Ex. 3 | +23.7 | " | +24.1 | " |
| Ex. 4 | +18.3 | " | +18.0 | " |
| Ex. 5 | +21.0 | " | +19.8 | " |
| Ex. 6 | +26.2 | " | +22.4 | " |
| Comp. Ex. 1 | +26.7 | " | +11.2 | blank spot formed in black solid |
| Comp. Ex. 2 | +24.8 | " | +12.6 | blank spot formed in black solid |
| Comp. Ex. 3 | +7.6 | fogged | +7.2 | image not developed |
| Comp. Ex. 4 | +18.6 | good | +9.1 | blank spot formed in black solid |
| Comp. Ex. 5 | +5.2 | fogged | +5.0 | image not developed |
| Comp. Ex. 6 | +4.8 | fogged | +5.1 | " |

*1Ambient Condition (I): 20° C., 65% RH
*2Ambient Condition (II): 35° C., 90% RH
*3Q/M: charge per g of toner (μc/g)

Moreover the toners obtained in Example 2 and Comparative Examples 7 and 8 were examined in terms of the fixing property and the offset-proof property. This test was conducted with a copy machine in which the fixation temperature was variable and the coater of silicone oil had been removed out. The fixing property was examined with the peeling test of an adhesive tape. Results are shown in Table 2.

TABLE 2

| toner | minimum temperature of fixation | temperature at which offset appears |
|---|---|---|
| example 2 | 140° C. | no offset at 240° C. |
| comparative example 7 | 140° C. | offset appeared at 160° C. |
| comparative example 8 | 160° C. | offset appeared at 190° C. |

It is understood from the results of Table 2 that the toner according to the invention was fixed at a lower temperature than the comparative examples and did not produce offset at a high temperature.

Comparative Example 7

One hundred parts of xylene as a polymerization solvent was introduced into a reactor equipped with an agitator, a dropping funnel, a nitrogen gas-introducing tube, a refluxing device and a thermometer. Then, a mixture of 86.2 parts of styrene, 11.7 parts of 2-ethylhexyl acrylate, 2.0 parts of dimethylaminoethyl methacrylate, 0.1 part of divinylbenzene and 2.0 parts of azobisdimethylvaleronitrile was added dropwise to the solvent at 80° C. under a stream of nitrogen gas, while the polymerization was proceeding. Thereafter, the reaction system was placed under a reduced pressure. All the volatile matters such as the polymerization solvent and the remaining monomer were distilled out while the reaction product was gradually heated. In this way, a binder resin was obtained. The SP of the resin was 125° C. and Tg of the resin was 68° C. Further a toner was prepared in the same way as shown in Example 1.

Comparative Example 8

A binder resin was obtained in the same manner as shown in Comparative Example 7 except that azobisdimethylvaleronitrile was used in an amount of 1.0 part. The SP and Tg of the resin were 132° C. and 70° C., respectively. A toner was prepared in the same way as shown in Example 1.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The embodiments of the invention in which an exclusive property or priviledge is claimed are defined as follows:

1. A dry developer composition for electrophotography capable of accepting a positive charge comprising a binder resin and a colorant, wherein said binder resin comprises a polymer obtained by polymerizing, in a suspension, (A) 98 to 99.95 parts by weight of a hydrophobic copolymerizable monomer and (B) 0.05 to 2.0 parts by weight of a tertiary amino group-containing copolymerizable monomer having the formula (1):

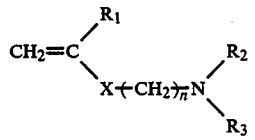

(1)

in which $R_1$ is hydrogen or methyl, X is —COO— or —CONH— $R_2$ and $R_3$ are each an alkyl having 1 to 4 carbon atoms or an aryl and n is an integer of 1 to 4, in the presence of (C) 0.5 to 5.0 parts by weight of an azonitrile polymerization initiator.

2. A dry developer composition as in claim 1, in which up to 2 parts by weight of said hydrophobic copolymerizable monomer has been replaced by a crosslinking agent.

3. A dry developer composition as in claim 1, in which said hydrophobic copolymerizable monomer (A) has a solubility in water of not higher than 1.0 wt. % or a solubility of water in said monomer (A) is not higher than 1.0 wt. %.

4. A dry developer composition as in claim 1, in which $R_2$ and $R_3$ in the formula (1) are each an alkyl having 2 to 4 carbon atoms.

5. A dry developer composition as in claim 1, in which said azonitrile polymerization initiator (C) has a group of the formula (2) attached to the azo group.

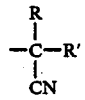

(2)

in which R and R′ are each an alkyl or alkoxy both having 1 to 5 carbon atoms.

* * * * *